United States Patent [19]

Huddle

[11] 4,028,861

[45] June 14, 1977

[54] ERECTION METHOD FOR A VAULTED MEMBRANE STRUCTURE

[75] Inventor: Carl Frederick Huddle, Pleasant Ridge, Mich.

[73] Assignees: Tension Structures Co., Pleasant Ridge, Mich.; Jon D. Vredevoogd, Lansing, Mich. ; part interest to each

[22] Filed: June 29, 1976

[21] Appl. No.: 700,846

Related U.S. Application Data

[63] Continuation-in-part of Ser. No. 597,970, July 21, 1975, which is a continuation-in-part of Ser. No. 399,333, March 8, 1973, abandoned, which is a continuation-in-part of Ser. No. 93,293, Nov. 27, 1970, abandoned.

[52] U.S. Cl. ..... 52/745; 52/63; 52/86; 135/4 R

[51] Int. Cl.[2] ..... E04G 21/00

[58] Field of Search ..... 135/4 R, DIG. 1; 52/63, 52/86, 745

[56] References Cited

UNITED STATES PATENTS

| | | | |
|---|---|---|---|
| 2,225,972 | 12/1940 | Brogren | 135/4 R |
| 2,797,969 | 7/1957 | Fritsche | 135/DIG. 1 |
| 2,806,477 | 9/1957 | Fritsche | 135/4 R |
| 3,802,450 | 4/1974 | Huddle | 135/4 R |
| 3,820,553 | 6/1974 | Huddle | 135/4 R |
| 3,953,955 | 5/1976 | Huddle | 135/4 R X |
| 3,958,588 | 5/1976 | Huddle | 135/4 R |
| 3,961,638 | 6/1976 | Huddle | 135/4 R |

*Primary Examiner*—Werner H. Schroeder
*Assistant Examiner*—Conrad L. Berman

[57] ABSTRACT

A highly tensioned membrane structure supported by vertical curved arches that are semi-rigid or flexible in that they may sway in high winds. The tensioned membrane has sufficient inward curvature between arches to oppose arch deflection which greatly reduces the arch cross-section required. Such flexible arches require special erection procedures such as raising the arches by "bunching" or "ganging" them together or the use of an auxilary erection arch to prevent arch deformation during erection, especially when heavy membranes are attached to the arches. All of the arches are raised at once or in groups that support a section of the structure. The sections are then attached to each other along with end closures, if any.

20 Claims, 19 Drawing Figures

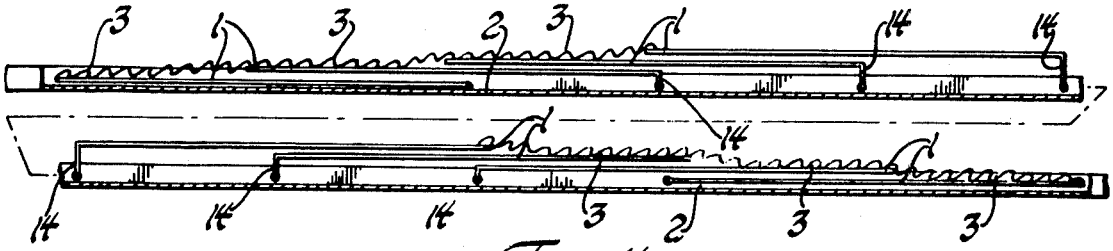
Fig. 4
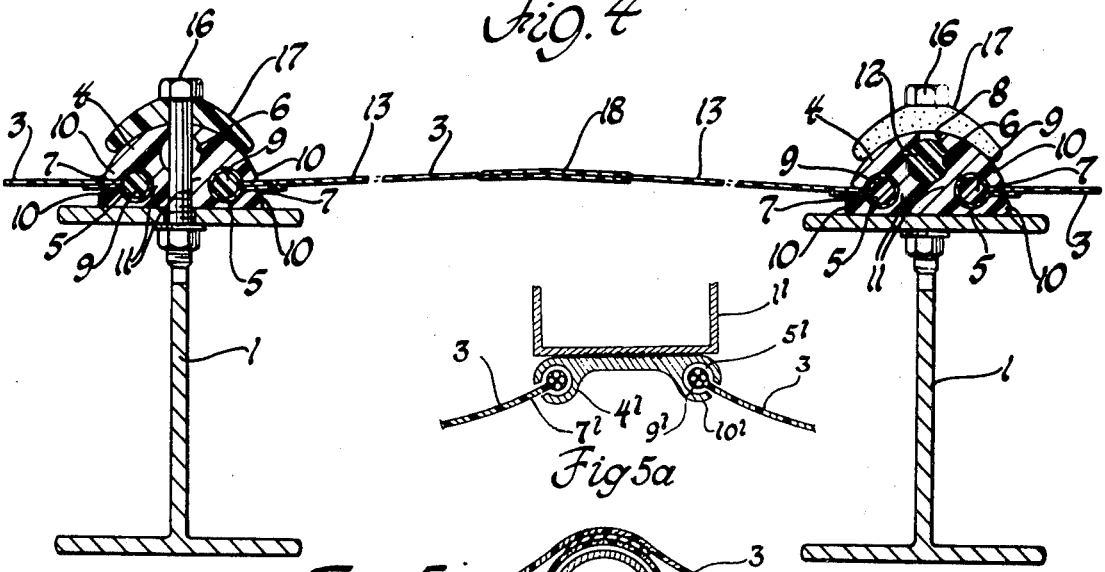
Fig 5a
Fig. 5
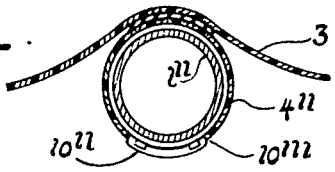
Fig. 5b
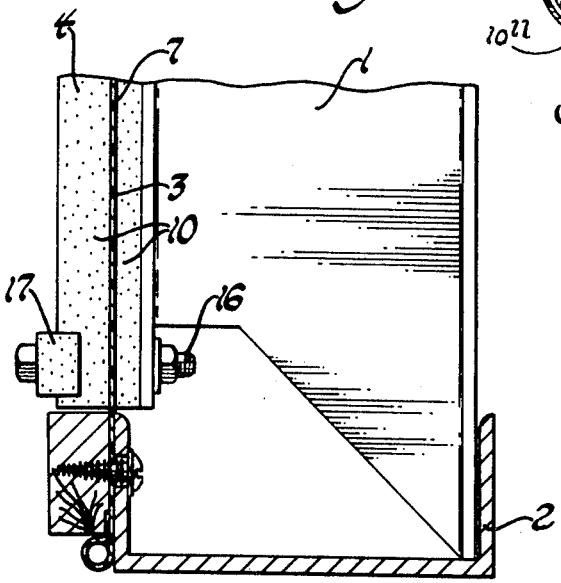
Fig. 6
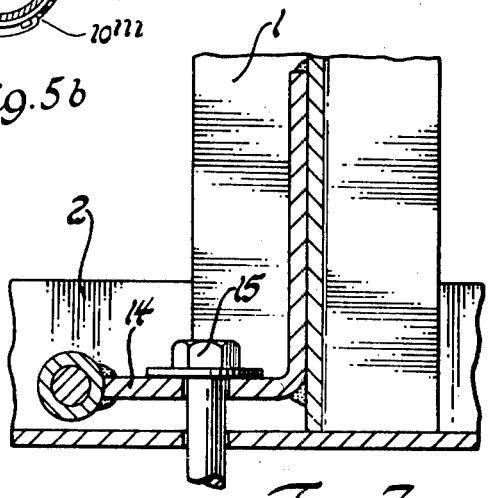
Fig. 7

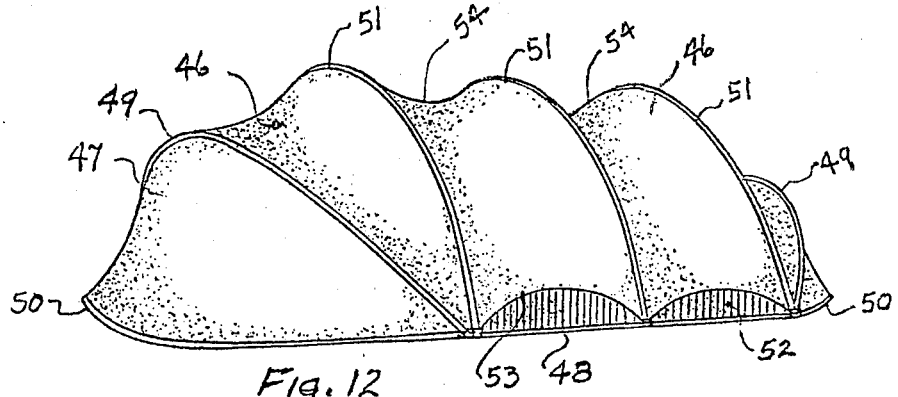
Fig. 12
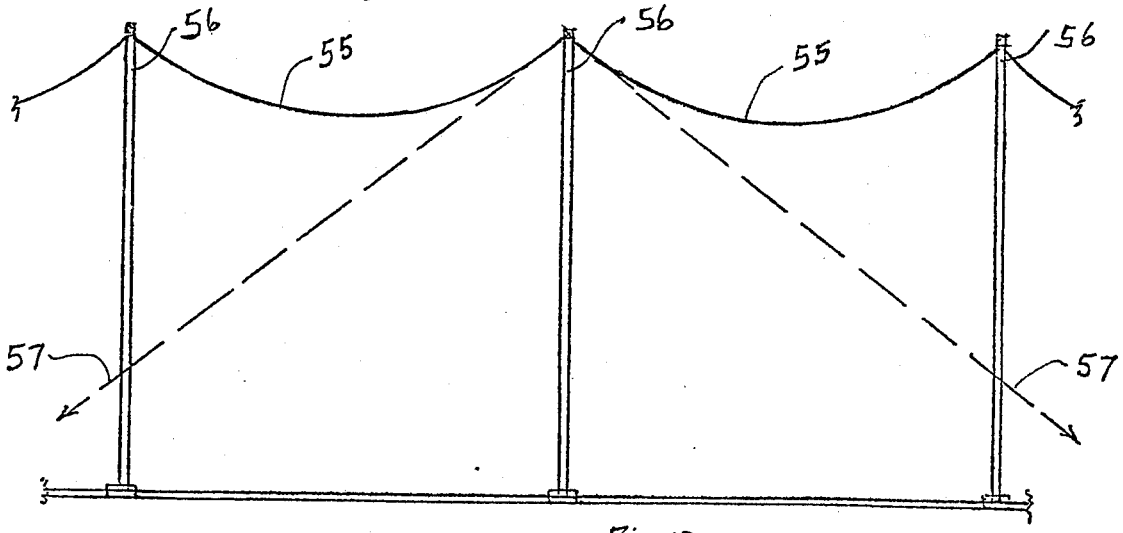
Fig 13
Fig 15
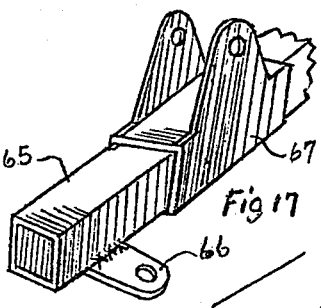
Fig 17
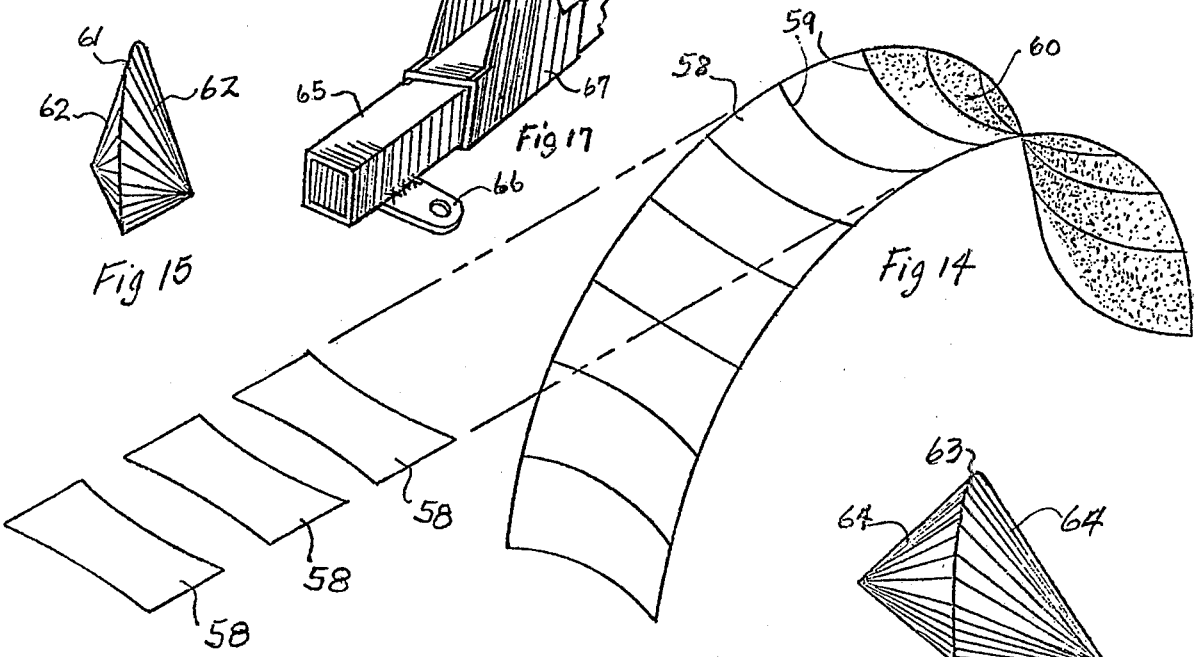
Fig 14
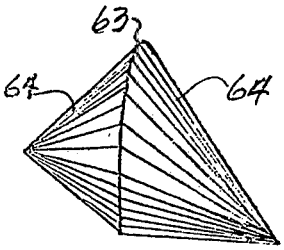
Fig 16

ERECTION METHOD FOR A VAULTED MEMBRANE STRUCTURE

BACKGROUND OF INVENTION

This application is a continuation in part of application Ser. No. 597,970 7/21/75 which is a continuation in part of application Ser. No. 399,333, 3/08/73 now abandoned, which is a continuation in part of the parent application Ser. No. 93,293 filed Nov. 27, 1970, now abandoned.

This invention relates to a method of erection of vaulted membrane shelters having highly tensioned membrane in double curvature that are supported by a framework of curved arches spaced apart in a modular pattern.

SUMMARY OF INVENTION

The principal object of the invention is to provide a method of erection for these vaulted structures, comprised of arch supported tensioned membranes in double curvature that prevents membrane vibration, enables the membranes to carry heavy loads of snow, ice and wind without undue stress, and also stabilizes the structure by opposing arch deflection thereby greatly reducing the arch cross-sectional area and cost. By this erection method, these flexible arches of small cross-section can be easily raised to vertical positions with the membranes attached and then moved to their erected position. The membrane tensioning and anchoring of the structure then completes the erection procedure.

BRIEF DESCRIPTION OF THE DRAWINGS

FIG. 4 is a simplified schematic sketch of pivotal arches with offset hinges to move the arches apart in the erected position.

FIG. 5 shown a membrane attachment to the arches in the section 6-6 in FIG. 1.

FIG. 5*a* shows another membrane attachment to an arch suitable for small structures.

FIG. 5*b* illustrates a membrane attachment to an arch for a one piece cover or for large sections that span several arches.

FIG. 6 is a section at the base of lines 5—5 in FIG. 1.

FIG. 7 is a section at a right angle to FIG. 6 through the lower end of an arch.

FIG. 12 is a thumbnail perspective of a typical small shelter of this specie.

FIG. 13 is a schematic sketch illustrating the tangential pull of an inwardly curved membrane on a support arch.

FIG. 14 schematically illustrates one method of fabricating an inward curvature in a roof membrane between support arches.

FIG. 15 schematically illustrates how an arch is "captured" by tension members much like spokes of a bicycle wheel captures the rim and prevents rim deflection.

FIG. 16 schematically illustrates how tension members or a membrane captures the arch in these structures.

FIG. 17 illustrates a sub-base such as a base rail with a sliding arch attachment means.

DESCRIPTION OF THE PREFERRED EMBODIMENTS

Figure 1:
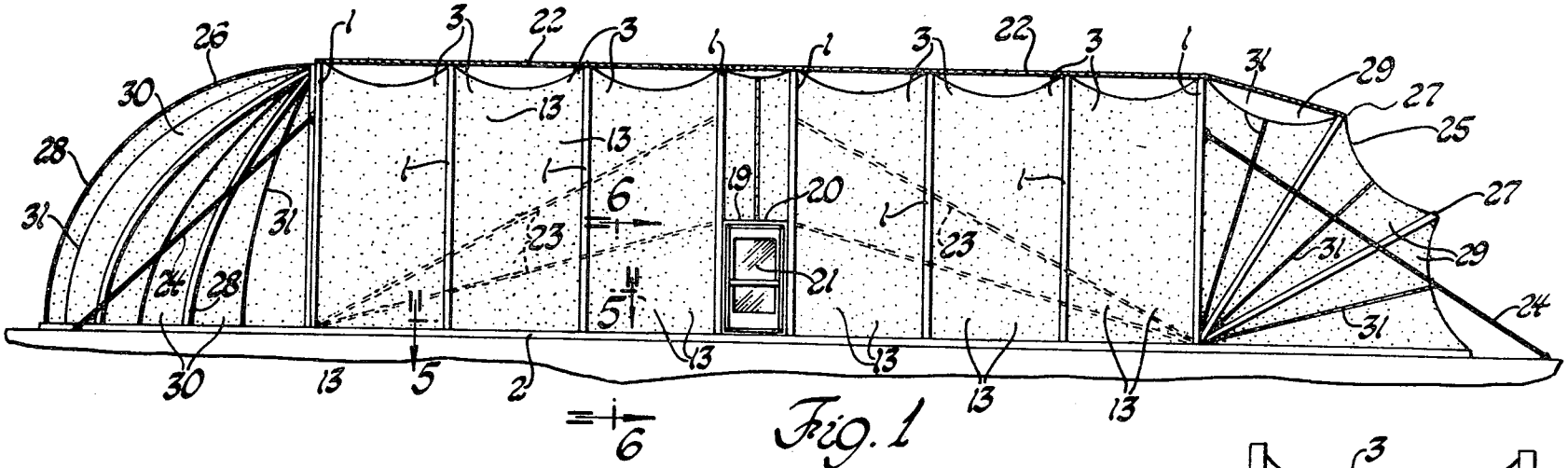
FIG. 1 is a side elevation of a vaulted structure in accordance with the invention.
Figure 2:
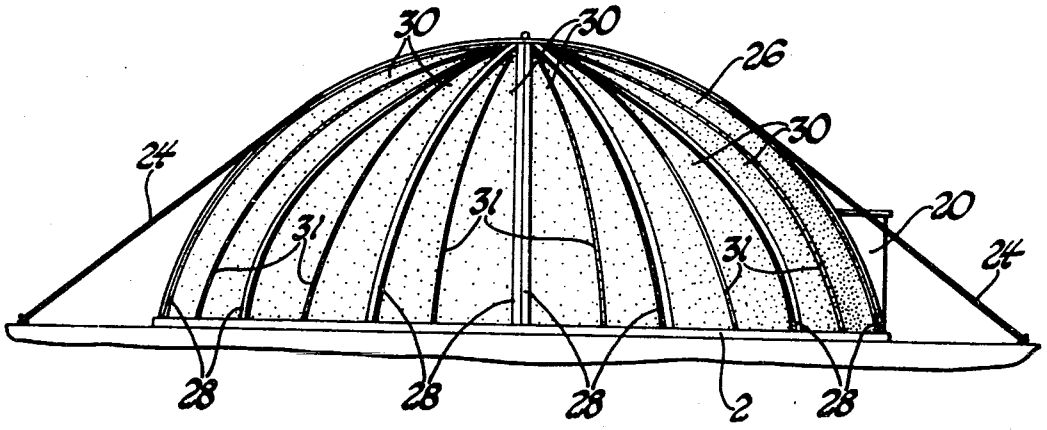
FIG. 2 is a left end elevation of FIG. 1.
Figure 8:
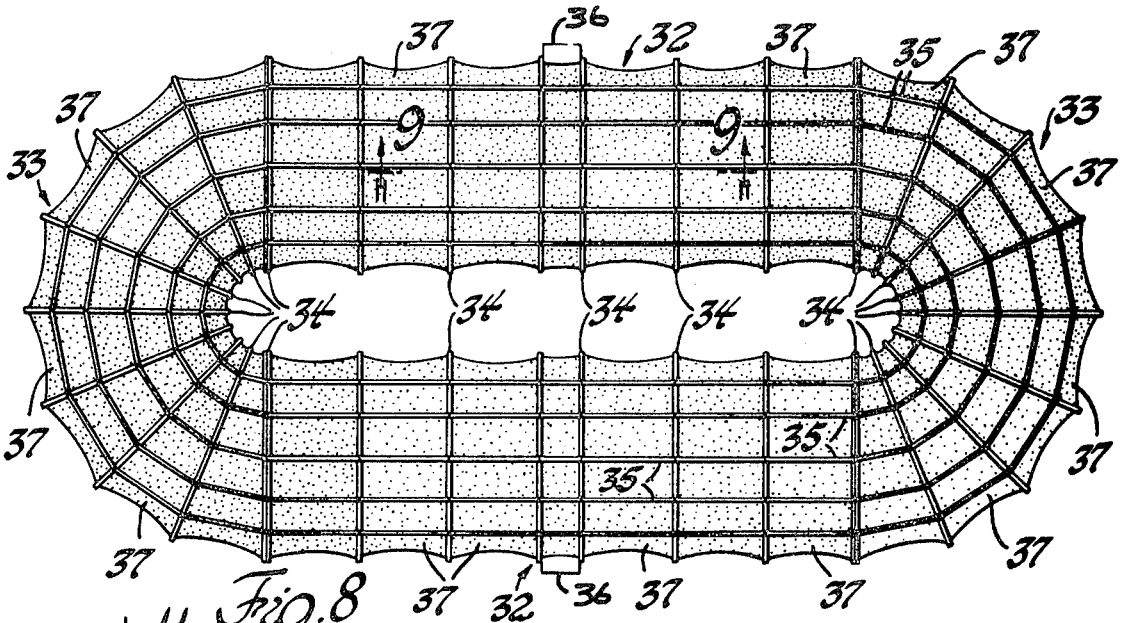
FIG. 8 is a top plan view of another shelter in accordance with the invention.

The vaulted structure shown in FIGS. 1 & 2 of the drawings include a series of curved arches 1 mounted on the ground or other base 2 to serve as a frame to support a tensioned membrane 3 which extends between the arches and is operatively attached to them. The membrane usually consists of a suitable fabric, coated fabric or other flexible membrane material that is stretchable within limits and is selected to serve within its elastic limits.

When the shelter is made in modules the membrane 3 is usually made in panels that extend between the arches and is attached to them through the intermediary of a fastening means 4, $4^1$ and $4^{11}$ such as shown in FIGS. 5, 5*a* & 5*b* respectfully.

This fastening means 5, and $4^1$ consists of tunnel 5 and $5^1$ in FIG. 5 and FIG. 5*a* respectfully, through which a beaded edge 9 and $9^1$ of the membrane extends with the membrane emerging through a slit 7 and $7^1$ in the tunnel wall respectfully. In the case of FIG. 5, the fastening means 10 is made of a fairly hard rubber type material so that the slots 7 can be opened to admit the beaded edge into the tunnels 5 when tunnel 6 is empty. After the beads 9 are inserted in the tunnels 5, a filler strip is inserted in the tunnel 6 that locks the lips 7 of tunnel 5 to retain the beaded edge in the tunnel 5.

The fastening means $4^1$ shown in FIG. 5*a*, is usually made of metal with fixed tunnels $5^1$ which can be extruded in the fastener or the arch. In this case, the beaded edges $9^1$ must be inserted in the tunnels $5^1$ by threading the beaded edge $9^1$ in the tunnel $5^1$ by sliding the membrane 3 in the slot $7^1$ along the arch $1^1$ or sliding the arch along the edge of the membrane. The fastener $4^1$ can be fastened to the arch $1^1$ by spot welding or metal fasteners. This fastener is used mostly for small structures where the arches and membranes to be attached are easy to handle.

The fastening means illustrated in FIG. 5*b* is adaptable when the membrane 3 is made in one piece or in large pieces that span several arches $1^{11}$. The membrane 3 fits over the arches $1^{11}$ and is usually attached to the arches $1^{11}$ by a fastening means $4^{11}$ that is in the form of a boot that encloses the arch $1^{11}$. The lacing $10^{11}$ that holds boot together between grommets $10^{111}$, could be comparable to the lips 10 and $10^1$ of the fasteners in FIG. 5 and FIG. 5*a*. The boot $4^{11}$ is welded or sewn to the cover 3. The boot $4^{11}$ is usually installed on the crown on the arches and extends over only 10–20% of the arch span. Pockets or closed boots can also be made in the membrane to attach it to the arches continuously or intermittently.

The panels of the covering material are made in curved trough-shaped surfaces 13 to minimize the tendency of the material to flutter and vibrate in gusty winds and to enhance its ability to carry heavy loads of snow, ice and wind without undue strain. The maximum depression of the panels between the arches is preferably at least 5–10l% of the distance between the arches.

The frame of arches 1 can be erected in various ways: by pivoting the arches on the base, with or without the membrane attached; by lifting each arch individually and fixing it in space by such means as the cables 22, 23 & 24, by pivotal raising or just lifting several arches, with or without the membrane attached, to their erected position; then fixing them in place by means of the cables 24, or purlins 35, or by means of the end closure 25 comprised of membranes 29 with arches 27 or the end closure 26 comprised of membranes 30 and semi-arches 28.

The arches 1 can be properly spaced by moving their ends apart on the base and spacing their summits by stretching the membranes 3 to a predetermined tension, by the use of purlins, or the cable 22. The latter can act as a safety means to prevent collapse in case of membrane failure. In any case, the arches can be properly aligned in their upright position by guys 23 connected to the middle pair of arches and to the base 2. Guys 24 can be connected to the outermost arches and to the base to hold the arches apart after the membrane 3 is tensioned. The guys 24 can also be used to pull the arches apart to tension the membrane above the base and to align the arches. Pulling down on the arches 27 in the end closure 25 on the right side of FIG. 1, can also tension the membranes 3.

Figure 3:
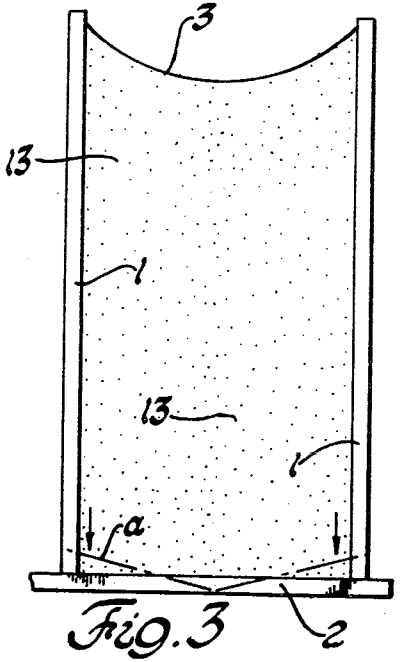
FIG. 3 illustrates one method of assembling the structure shown in FIGS. 1 and 2.

To impart a wrinkle free trough-shape to the widths of covering material in some shelters, the following expedient can be employed to eliminate wrinkles along the arch:

A width of covering material 3 of nearly rectangular or other appropriate shape and of the length necessary to follow the contour of the arches 1 and with an inward curvature of trough shape having the proper width with beaded edges 9 is employed. This width is attached to a pair of arches 1 in the manner described. Then the edges of the width are stretched to the extent necessary to make them of the same length as the periphery of the arches by drawing their ends down to the bottoms of the legs of the arches as diagrammatically indicated in FIG. 3 in which the broken line a indicates the disposition of the lower edge of the width before the lateral edges are stretched. This may be done either by pulling the lower ends of the edges of the width to the bottoms of the legs or by anchoring the lower ends of the edges and raising the bottoms of the legs. When the lateral edges of the width have been drawn down to the bottoms of the legs of the arches, they are clamped there by bolts 16 and jaws 17. The stretching operation is illustrated as it is in FIG. 3 primarily to facilitate and simplify illustration, but it may also actually be done while the arches are in upright positions as well as when they are in recumbent positions.

In somewhat larger or medium size structures, it is much easier to tension the lower portion of the panels 13 between the arches by stretching the panels toward the base by the use of tension rings as illustrated in FIGS. 8–11. The membrane can continue under the tension ring to the base. A detachable arrangement is generally used so that the portion of the membrane below the tension ring may be raised to create an opening under the tension ring for egress, ventilation or both.

Suitable closures may be provided for one or both ends of the structure such as the accordion-like structures 25 and 26 shown in the drawing, which may be collapsed to open ends. The closures 25 and 26 are generally similar in construction to the body of the structure in that they are made up of arches 27 in the case of the closure 25 and semi-arches 28 in the case of the closure 26 and widths 29 and 30 of flexible covering material which extend between and are attached to the arches. Membrane reinforcement strips 31 are sometimes added to relieve stress on the membrane seams at the bottom of the curvature.

However, the arches 27 of the closure 25 are mounted on the base 2 near the lower ends of one of the outermost arches 1 to swing about a horizontal axis upwardly to collapse the closure and open the end of the structure and downwardly to close it.

The summits of the semi-arches 28 of the closure 26, on the other hand, converge at the summit of the other outermost arch 1. The closure 26 is made in two halves which meet at a projection of the center line of the structure to close the end of the structure. The semi-arches are, however, mounted to swing about a vertical axis at the point of convergence of their summits to collapse each half against a leg of the end arch 1 and open the end of the structure.

Vaulted structures in accordance with my invention may be curvilinear of circular or ellipsoidal in shape instead of straight and include modules of different widths, shapes and materials.

Different means of attachment of the covering material to the arches and different methods of depressing and tensioning the flexible covering material between the arches may be also employed. A structure in which some of these and additional features are employed is illustrated in FIGS. 8–11.

The structure shown in FIGS. 8–11 is shaped like an ellipsoid or an elongated doughnut. It consists of two similar straight sections 32 disposed side by side with their ends interconnected by curved sections 33.

The sections 32 are similar in a general way to the body of the structure shown in FIGS. 1–7 and the sections 33 are also generally similar except in the arches 34 converge toward their inner sides and the modules are, therefore, frusto-triangular instead of rectangular in plan. The arches 34 are kept properly spaced by purlin 35. An entry or entries 36 with door or doors in them may be provided in one or more of the modules.

The arches may or may not be mounted to swing on the ground or other base 2 but, in either event, they are mounted so that they may be moved toward and away from each other to facilitate the attachment of covering material 37 to the arches 34, to tension the membrane 37, to align the arches 34, and in some cases, to readjust the tension in the membranes 37.

Figure 10:
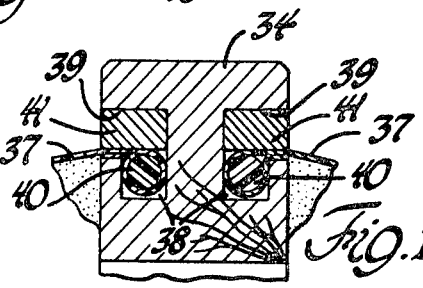
FIG. 10 is an enlarged view of the section of one of the arches shown in FIG. 9.

The arches 1 & 34 may be made of curved laminated wood, metal, composites or other material. Another method of attaching the flexible membrane panels 37 to the arches is shown in FIG. 10, where there is provided in each side of the arches, a tunnel 38 into which extends a lock slot 39 through which the beads 40 on the edges of the widths 37 may be introduced into the tunnels. To hold the beads in the tunnels there are provided lock strips 41.

After the panels of covering material are attached to the arches and the arches are erected, one method of tensioning the panels is to move the arches apart sufficiently to tension the panels within their lower elastic limit. The cables 24 may be used to hold the arches apart or the end closures 25 & 26 with their respective arches and membranes can be used to hold the arches apart. The lower edges of the panels 3 are then pulled downward toward the base 2 to tension the lower portion of the membrane that will move upward, away from the base 2, as the arches are moved apart to tension the membrane longitudinally and transversely since this arch movement tends to decrease the inward curvature between the arches. However, the diagonal strength of the membrane resists the upward movement of the membrane except in the lower portion where it diminishes towards zero at the lower edge of the membrane.

In the panels 37 of covering material employed in the structure shown in FIGS. 8–11, a means to tension and depress the panels of covering material between the arches near the base, in large structures, there is provided, near the lower edges of the panels, one or more tension rings 42 of the type disclosed in my application entitled, "Prestressed Arch Supported Membrane Shelter," Ser. No. 336,228 filed Feb. 27, 1973, now abandoned. Where tension rings are used there should be provided at least one tension ring for each surface 37. Each of these tension rings consists of a cable 43 which extends through an arched tunnel 44 embodied in or on the panel of covering material with its ends attached to the base 2 or to the ends of the arches 34. The cable may itself be a spring member or be attached to the base by a spring as shown in my application above identified.

Figure 9:
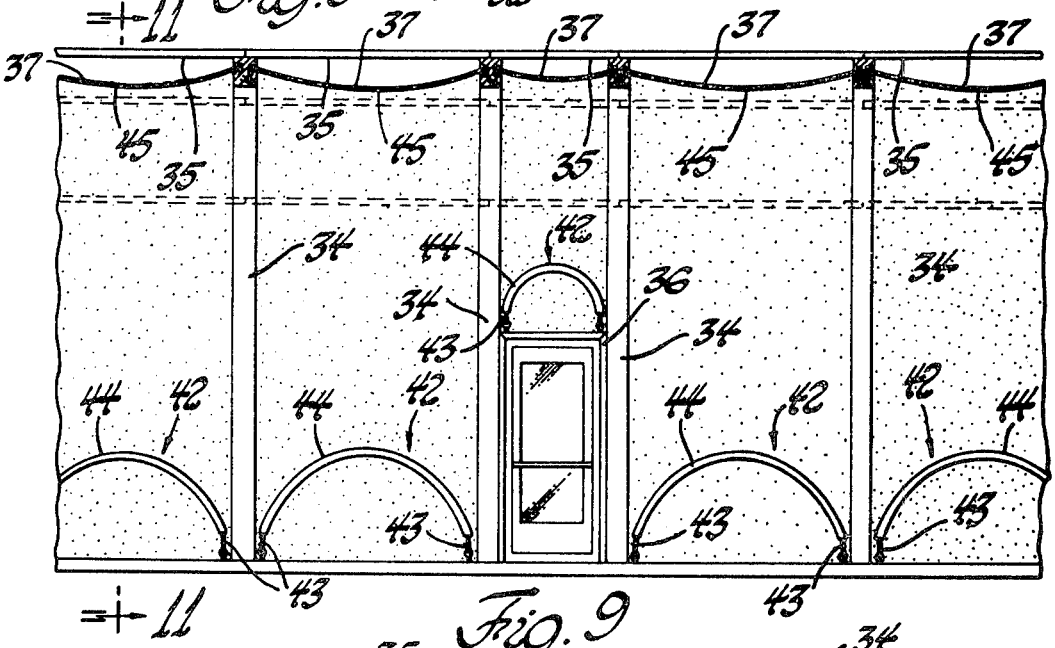
FIG. 9 is an enlarged view of the section line 9—9 of FIG. 8.
Figure 11:
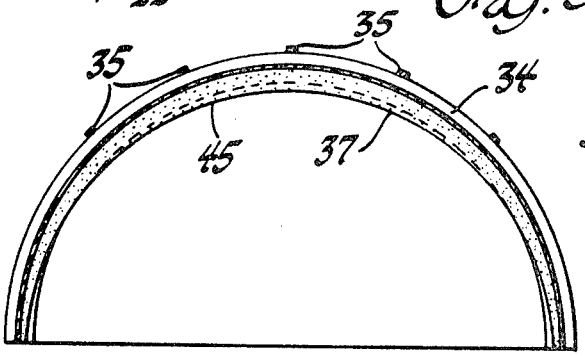
FIG. 11 is a view of the line 11—11 of FIG. 9.

In any event, the cables 43 are tensioned sufficiently to draw the edges of the panels of covering material towards the base, tension the lower portion of the membrane widths with or without a depressed intermediate portion of the panels as indicated at 45 in FIGS. 9 & 11. The curved depression can vary from crown to base, as desired, as load conditions dictate.

The roof membrane may be attached directly to the base without an inward depression along the base if side snow loads by drifting or piling are below the membrane elastic limit. Above this area, the membrane curves transversely with the arches and inwardly between the arches longitudinally.

FIG. 12 illustrates a shelter wherein the membrane 46 is tensioned between the end closures 47 by pulling the arches apart on the base rail 48 and pulling down on the closure arch 49 and the base arches 50. The vertical arches 51 can be exact duplicates of each other and the membranes between them can be made alike for economy or dissimilar, for architectural treatment or to provide ventilation openings 52 or other openings as desired. A base rail 48 or a shelter base, such as a floor slab, can be used to serve as a horizontal adjustable means and as a means to anchor the arches to the ground. The membrane 52 under the tension ring 53 can be detachable to the base rail 48 or to a sub-base. In some structures such as car ports or farm shelters it is not necessary to provide floor slabs or base rails as the arches can be separated manually and staked to the ground. The membrane 52 under the tension ring 53 may be omitted and the roof membrane may extend to the ground where it can be fastened continuously or intermittently to the ground or to a spacer, such as wood strut, between the ends of the arches 51.

The inward curvature between the arches 54 illustrates very well how the membrane captures the supporting arches 51 and 49 and opposes arch deflection. This allows the use of smaller arch cross-sections and/or lower moment of inertia. The arches can be flexible like aircraft wings or automobile frames and still serve as a stable, safe and dependable support frame for the tensioned membranes.

FIG. 13 illustrated further how the membrane captures the arches if sufficient inward curvature is fabricated in the membrane 55 supported by the arches 56. The tangent line 57 indicates the line of force exerted by the tensioned membrane 55.

FIG. 14 illustrates one method of fabricating the inward curvature or trough shaped membrane between the support arches. Panels 58 are patterned in hour glass shapes, then fastened together 59 to form a trough 60. This trough can be variable from crown to the base or it can be always the same depth for economy or to meet required environmental conditions as the inward curvature enables the membrane to carry heavy live loads without undue stress and the double curvature opposes vibration and flutter of the membrane. The membrane panels 58 do not need to be cut or patterned in this shape but they must be fastened together with seams of this shape or otherwise to create the curved trough shape. FIG. 14 was included in my Pat. No. 3,820,553, dated June 28, 1974 in which it was shown as FIG. 16.

FIG. 15 illustrates how an arch 61 would be captured by spokes 62 similar to a bicycle wheel with a wide hub.

In FIG. 16 the same analogy is used to illustrate how the arch 63 is captured with spokes 64 that have a similar slope as the tangents 57 in FIG. 13. By assuming the components are the same in FIGS. 15 & 16, except for the length of the spokes, the arch in FIG. 16 has sacrificed some vertical stability but has gained some lateral stability and also gained ground area covered by the spokes. The optional design arrangement is to provide the desired sheltered area without sacrificing too much vertical stability.

In FIG. 17 illustrates a means whereby the arches can be mounted to swing and also moved toward and away from each other as stated previously. A base rail 65 can be anchored to a base or the ground by bolting or otherwise anchoring through the hole in plate 66 which is fastened to the base rail in a location that will not interfere with the movement of the arches to tension the membranes. The arch is pivotably attached to the component 67 which slides on and encompasses the base rail thus securing the arch to the base. Actually, once the shelter is erected and the membrane is anchored to the base, or a sub-base or base rail, the anchoring of the arch becomes only a positioning device as the strong membrane can keep the shelter from blowing away. The base rail 65 can be continuous or segmented. In smaller shelters, the arches can be mounted directly on a base or non-sliding sub-bases.

While such shelters as this are classed as "tentage," these shelters are as different from the popular tents of yesterday as day and night. Large tents were made primarily of canvas that was dimensionally sensitive to humidity which made it a constant maintainance problem. It was also comparatively weak in tensile stress — usually around 50 lbs. per inch of width. In tents, these low strength membranes only served as the roof of the shelter that vibrated and galloped in high winds to destructive states. It contributed very little, if anything, to the horizontal stability of the tent.

The membranes available today have tensile strengths of up to 30 or more times the strength of the canvas used in the old tents, are reasonably stable in wide ranges of weather conditions and have much longer life expectancy. In these new shelters, the curved membranes not only serve as strong roof and walls, but they contribute vital stability without vibration to the shelter. In intermediate and large structures, the horizontal movement of the arches apart from each other tensions the membrane longitudinally which, in turn, decreases the inward curvature of the membrane (to a pre-determined degree) which simultaneously tensions the membrane transversely. The degree of decrease in curvature depends on the fabric weave and the stretch due to tension. Wrinkle-free membranes, stiffened under high initial tension in a double curvature configuration within the lower range of their elastic limits, make these shelters feasible, economical and remarkably stable with arches that are almost unbelievably small in cross-section.

I claim:

1. A method of constructing a vaulted membrane structure comprising a frame of substantially vertical arches with curved bights spaced apart with their respective ends aligned and mounted on a base to permit horizontal movement; a flexible roof membrane extending between and operatively attached to said arches and said base that is tensioned to a stiffened state with an inward concave curvature between the bights of said arches, said inward concave curvature having been formed by said membrane having a shorter circumference in a vertical plane midway between adjacent arches than its circumference where it is operatively attached to said adjacent arches and means to fix said arches in their erected position to maintain tension in said roof membrane; said method of erection comprising the following steps:

a. Prefabricating said roof membrane in sections or as a whole such that its circumferential length is a vertical plane midway between adjacent vertical arches is less than its circumferential length where it is operatively attached to said adjacent vertical arches, b. Assembling and disposing said vertical arches, comprising at least one section of said shelter frame, on the base in recumbent positions with their corresponding ends aligned and their crowns similarily oriented but spaced apart sufficiently to facilitate attaching said membrane, c. Operatively attaching said roof membrane to at least a portion of the crown of said arches, d. Raising at least two arches, while abutting each other, to an upright position, e. Moving said arches apart and tensioning the membrane as the arches are moved to their final position, f. Fixing said arches apart to maintain tension in said membrane, g. Securing the lower portion or edge of said membrane between said adjacent arches.

2. The method described in claim 1 wherein at least two arches are coupled together, to reduce their flexing, before they are raised in step d) to upright positions.

3. The method described in claim 1 wherein an auxilary erection arch is coupled with at least one of said vertical arches to reduce its flexing and/or bending of the frame arch, as it is raised to an upright position in step d).

4. The method described in claim 1, wherein raising of said arches to an upright position in step d) includes swinging at least two arches upward about at least one pivotal means attached directly or indirectly to the base.

5. The method described in claim 1 wherein said arches are moved apart in step e) includes sliding the ends of the arches along a base rail to which they are attached.

6. The method described in claim 1 wherein the securing of the lower portion or edge of the membrane between adjacent arches includes attaching said membrane to the base or to a base rail extending between said arches and anchored to the base.

7. The method described in claim 1 with the addition of anchoring said arches directly or indirectly through a sub-base to the base or ground in step g).

8. The method described in claim 1 with the addition of attaching additional sections and end closures of the shelter, if any, to an erected section, then tensioning the interconnecting roof membrane.

9. The method described in claim 1 wherein the fixing of said arches apart in step f) includes the installation of at least one compression strut between two arches.

10. The method described in claim 1 step e) wherein the tensioning of said membrane includes the elongation of at least one extensible strut extending between at least two arches.

11. The method described in claim 1 wherein the tensioning of said roof membrane in step e) includes the movement of at least one end closure arch indirectly attached to an end vertical arch by means of a membrane, attached to and extending between them.

12. The method described in claim 1 wherein said vertical arches are mounted on a base in parallel relationship.

13. The method of erection described in claim 1 except that said respective end of said arches are non-aligned and said arches are spaced in non-parallel relationship to form a curved shelter.

14. The method of erection described in claim 1 wherein the frame of the structure includes at least one strut between adjacent arches.

15. The method of erection described in claim 1 with the addition of installing at least one safety member extending between at least two vertical arches to prevent the collapse of the structure in case of membrane failure.

16. The method of erection described in claim 1 that includes the attachment of at least one end closure comprising a semi-arch attached to an end arch and having flexible membranes extending between and operatively to said end arch and said semi-arch.

17. The method described in claim 1 step e) wherein the tensioning of said membrane includes a tensioning means acting between at least one vertical arch and said base.

18. The method described in claim 17 wherein tensioning of said roof membrane includes increasing the tension in a tension member extending between an end vertical arch and said base.

19. The method of erection described in claim 1 wherein the shelter comprises an end closure that includes at least one arch inclined outwardly from the body of the shelter with its ends operatively attached to said base adjacent to the respective ends of an end arch; a closure membrane extending between and operatively attached to said end vertical arch and said inclined arch, said method further comprising tensioning said closure membrane by urging said inclined arch downward and fixing it to said base when performing step e).

20. The method of erection described in claim 19 wherein said inclined arch is urged downward by tensioning a membrane acting between said inclined arch and said base, when performing step e).

* * * * *